US006527383B1

(12) United States Patent
Lengyel et al.

(10) Patent No.: US 6,527,383 B1
(45) Date of Patent: Mar. 4, 2003

(54) ANTI-BUBBLE SHELF IN AN INK TANK

(75) Inventors: Dennis M. Lengyel, Hemlock, NY (US); Eric A. Merz, Webster, NY (US); Edward M. Carrese, Rochester, NY (US); David P. Breemes, Palmyra, NY (US); Hiep Nguyen, Rochester, NY (US)

(73) Assignee: Xerox Corporation, Stamford, CT (US)

( * ) Notice: Subject to any disclaimer, the term of this patent is extended or adjusted under 35 U.S.C. 154(b) by 0 days.

(21) Appl. No.: 09/617,486

(22) Filed: Jul. 14, 2000

(51) Int. Cl.[7] ..... B41J 2/19
(52) U.S. Cl. ..... 347/92
(58) Field of Search ..... 347/86, 85, 92, 347/94, 87

(56) References Cited

U.S. PATENT DOCUMENTS 4,580,147 A * 4/1986 DeYoung et al. ..... 347/88
5,509,140 A * 4/1996 Koitabashi et al. ..... 347/86
5,619,238 A * 4/1997 Higuma et al. ..... 347/86
5,760,806 A * 6/1998 Oda et al. ..... 347/87
5,886,721 A * 3/1999 Fujii et al. ..... 347/87
6,095,643 A * 8/2000 Cook et al. ..... 347/87

FOREIGN PATENT DOCUMENTS

JP 6-99585 * 4/1994 ..... 347/85
JP 2000-33715 * 2/2000 ..... B41J/2/175

* cited by examiner

*Primary Examiner*—Judy Nguyen
(74) *Attorney, Agent, or Firm*—Oliff & Berridge, PLC

(57) ABSTRACT

An ink tank which has an ink delivery port chamber and one or more free ink chambers is provided with free ink chamber ceiling heights which are lower than the ceiling height of the ink delivery port chamber to reduce the amount of air trapped in the ink tank when the ink tank is filled with ink, and to locate air trapped in the ink tank in the ink delivery port chamber.

16 Claims, 2 Drawing Sheets

ANTI-BUBBLE SHELF IN AN INK TANK

DESCRIPTION OF RELATED ART

This application is related to U.S. patent application Ser. No. 09/597,550, entitled "FAIL SAFE INK TANK LATCHING SYSTEM," filed on Jun. 19, 2000, and U.S. patent application Ser. No. 09/597,545, entitled "INK TANK SUPPORT ASSEMBLY SEAL AND BIASING ELEMENT," filed on Jun. 19, 2000, and U.S. patent application Ser. No. 09/597,544, entitled "INK TANK WITH SECURING MEANS AND SEAL," filed on Jun. 19, 2000, and U.S. patent application Ser. No. 09/597,285, entitled "VARIABLE CAPACITY AND STAGGERED WALL INK TANKS," filed on Jun. 19, 2000, the disclosures of which are incorporated herein in their entirety.

BACKGROUND OF THE INVENTION

Field of Invention

This invention relates to ink tanks.

SUMMARY OF THE INVENTION

This invention is directed to an ink tank for use in a printing device which has a plurality of ink chambers including one ink chamber having a supply/delivery port and a porous element in the chamber for absorbing and holding ink, and one or more free ink chambers, i.e., chambers which contain only ink and are free of ink absorbing and holding elements. When an ink tank is filled with ink, the ink displaces the air in the tank. However, if all of the air in the tank is not displaced by ink, the air remaining in the tank forms one or more air bubbles in the tank. Since air is lighter than ink, the air bubble or bubbles remaining in the tank rise and often rise to the top of the tank. Since ink tanks typically contain a number of ink chambers, with ceilings of the same height, one or more air bubbles tend to form at the top of each chamber. When the ink tank is heated, which may happen in normal operation of the device in which it is located, or the ambient atmospheric pressure in which the ink tank is located is low, such as may occur at high altitudes, the air bubble or bubbles trapped in one or more ink chambers of an ink tank will expand, pushing ink into the ink tank chamber which contains a wick or foam and an ink tank supply/delivery port, which is sealed prior to use. When an ink tank port seal is removed, however, ink may be forced out through the supply/delivery port because of the force exerted on the ink by expanded trapped air bubble(s). The invention is directed to providing free ink tank chambers with ceilings which are lower than the ceiling height of the ink tank chamber which contains an ink absorbing and holding element and the ink supply/delivery port. With this ink tank construction, any air trapped inside of the ink tank when the ink tank is filled will tend to rise to the highest level in the ink tank, which will be the top portion of the ink tank supply/delivery port chamber with a ceiling that is higher than the ceiling of any of the free ink tank chambers. Moreover, since no air will be trapped in the free ink tank chambers, and air will only become trapped in one ink tank chamber which contains the ink absorbing holding element, less air will be trapped in the tank as a whole. This means that the amount of air trapped in the ink tank will be less than if air were trapped in a number of ink chambers. As a result, if the ink tank is heated or placed in a relatively low pressure atmosphere, there will be less air to expand, and less of a force exerted on the ink by the expanded air, resulting in less chance of leakage from the ink tank due to expansion of air trapped in the ink tank during the ink filling process.

This invention reduces the amount of trapped air in an ink tank containing one or more free ink chambers and an ink delivery port chamber when the ink tank is filled with ink by lowering the height of the ceiling of each free ink chamber relative to the height of the ceiling of the ink delivery port chamber and further by filling the ink tank with ink.

DETAILED DESCRIPTION OF PREFERRED EMBODIMENTS

Figure 1:
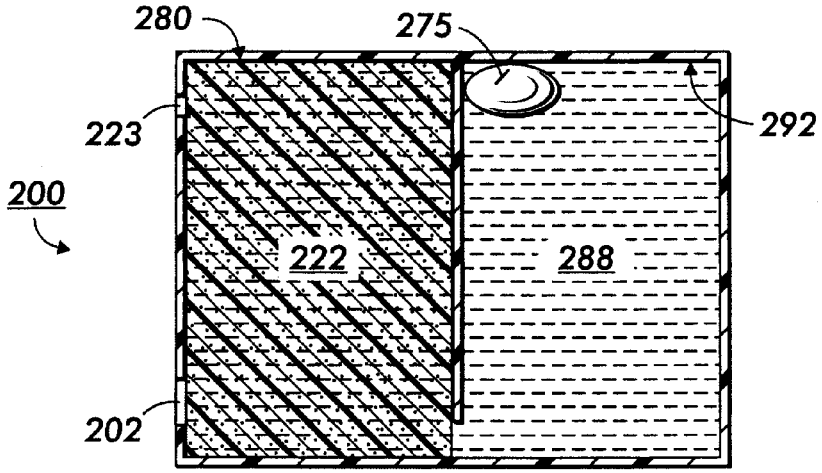
FIG. 1 is a cross-sectional view of an ink tank with a free ink chamber and an ink chamber with an ink wick.

FIG. 1 illustrates an ink tank 200 with ink chambers which have ceilings 292 of the same height. Only two chambers are shown, although an ink tank may have more than two chambers. The ink supply/delivery chamber 280 contains an ink containing foam or wick 222. The adjacent free ink chamber 288 is connected to the ink supply/delivery chamber 280 by an aperture 212, shown in FIG. 2. In operation, ink flows from the free ink chamber 288 into the ink supply/delivery chamber 280 and out of the ink supply/delivery chamber 280 through ink supply/delivery port opening 202. A vent opening 223 for the ink tank is also shown. In the ink tank of FIG. 1, an air bubble which formed upon filling of the ink tank with ink is depicted in the free ink chamber 288. Since an ink tank may contain several free ink chambers 288, an air bubble may be contained in each of the several free ink chambers 288.

Figure 2:
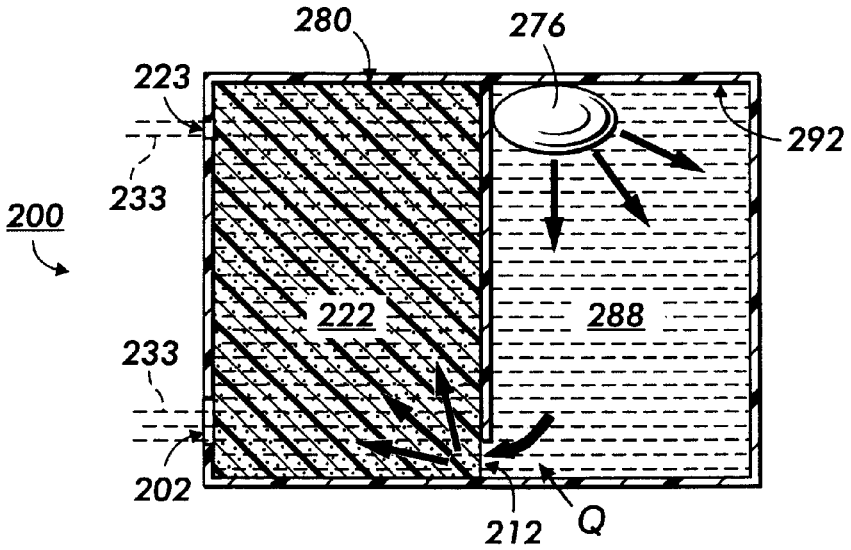
FIG. 2 is a cross-sectional view of an ink tank with a free ink chamber and an ink chamber with an ink wick.

FIG. 2 illustrates what happens when the ink tank, and its contents are subjected to increased temperature or decreased ambient atmospheric pressure. When the ambient pressure is lowered or the temperature of the tank and its contents is raised, the air bubble 276 in the free ink chamber 288 expands. The expanded air exerts a force Q on the ink in the free ink chambers 288 forces ink into the ink supply/delivery chamber 280. This can result in forcing ink out of the ink delivery supply port opening 202 and/or the ink vent opening 223. This spilled ink which is expelled or forced out of either or both openings 202 and 223 is depicted by the dashed lines labeled as 233 in FIG. 2.

Figure 3:
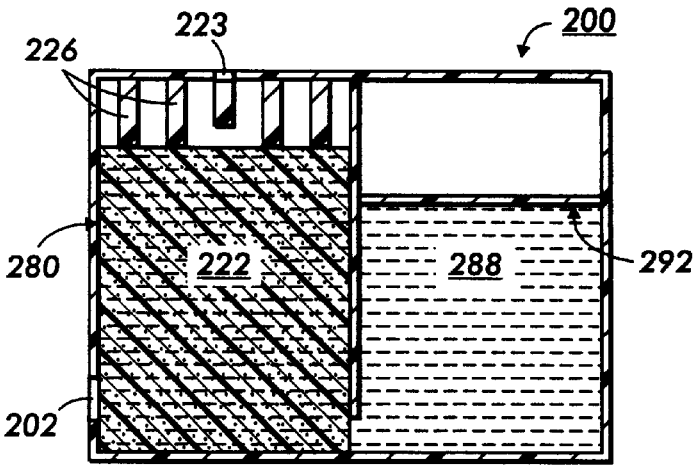
FIG. 3 is a cross-sectional view of an ink tank with a free ink chamber having a lowvered ceiling and an ink chamber with a wick.

To reduce the problem of spilled ink due to expansion of air retained in an ink tank when the ink tank is filled with ink, Applicants have lowered the height of the ceiling 292 of each of the free ink chambers 288 in the ink tank 200. FIG. 3 shows an ink tank 200 having a free ink chamber 288 having a ceiling 292 which is lower than the height of the ink supply/delivery chamber 280. In an ink tank 200 with several free ink chambers 288, the height of the ceiling 292 in each of the several free ink chambers 288 is made to be lower than the height of the ceiling in the ink supply/delivery chamber 280. FIG. 3 also shows an illustrative embodiment of an ink supply/delivery chamber 280 which has ribs 226 locates at the top of the ink supply/delivery chamber 280. The ribs 226 permit the wick element 222 to be relatively fixedly located within the ink supply/delivery chamber while also permitting an air space to be provided between the top of the wick element 222 and the ceiling of the ink supply/ delivery chamber 280. FIG. 3 shows the height of the ceiling 292 of the free ink chambers 288 as significantly lower than the height of the ceiling of the ink supply/delivery chamber 280. In actuality, the height of the ceiling 292 of each of the free ink chambers need be just below that of the ink supply/delivery chamber, and the significant lowering shown in FIG. 3 is exaggerated to clearly illustrate the relatively lower ceiling aspect of the invention, although one could lower the ceiling height of each free ink chamber as far as is illustrated.

This invention provides an ink tank construction which results in reducing air bubble formation in free ink tank chambers 288 and in reducing the total amount of air trapped inside of an ink tank when the tank is filled with ink so that leakage of ink is reduced or eliminated when the ink tank is subjected to increased temperatures or decreased ambient atmospheric pressure.

Figure 4:
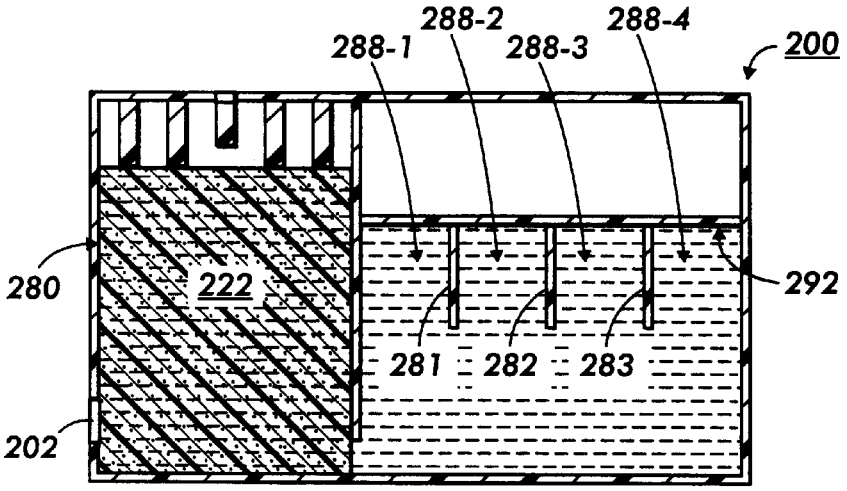
FIG. 4 is a cross-sectional view of an ink tank, with more than one free ink chambers.

FIG. 4 shows another exemplary embodiment of the invention in which the ink tank 200 contains a plurality of free ink chambers 288-1, 288-2, 288-3 and 288-4, separated by walls 281, 282 and 283. The ceiling 292 of the free ink chambers 288-1, 288-2, 288-3 and 288-4 is lower than the ceiling of the ink supply chamber 280.

While this invention has been described in conjunction with the exemplary embodiments outlined above, it is evident that many alternatives, modifications and variations will be apparent to those skilled in the art. Accordingly, the exemplary embodiments of the invention, as set forth above, are intended to be illustrative, not limiting. Various changes may be made without departing from the spirit and scope of the invention.

What is claimed is:

1. An ink tank structure comprising:

an ink tank having an ink chamber with an ink delivery port and a ceiling:

at least one free ink chamber having a ceiling with no apertures therein and located beside, but not below, the ink delivery port chamber and which is fluidly connected to the ink delivery port chamber to supply ink from the at least one free ink chamber to the ink tank chamber having an ink delivery port; and wherein the height of the at least one free ink chamber ceiling is lower than the height of the ink tank chamber having the ink delivery port.

2. The ink tank structure of claim 1, further comprising:

a plurality of free ink chambers; and wherein the height of the ceiling of each free ink chamber is lower than the height of the ceiling of the ink delivery port chamber.

3. The ink tank structure of claim 1, further comprising:

an ink wick clement located in the ink delivery port chamber.

4. A method of reducing the amount of air trapped in a free ink chamber of an ink tank containing one or more free ink chambers having a ceiling with no aperture therein and located beside but not below an ink tank chamber having an ink delivery port to supply ink to said ink tank chamber having an ink delivery port when the ink tank is filled with ink, comprising:

locating the height of the ceiling with no aperture therein of each free ink chamber at a height below the height of the ceiling of the ink tank chamber having an ink delivery port.

5. A method according to claim 4, further comprising:

filling the ink tank with ink.

6. The ink tank structure of claim 1, wherein the ink tank chamber having an ink delivery port comprises an ink tank delivery port which is located in a wall of the ink tank chamber having the ink delivery port.

7. The ink tank structure of claim 1, wherein the at least one free ink chamber having the ceiling and the ink tank chamber having the ink delivery port are located side-by-side.

8. The ink tank structure of claim 6, wherein the wall in which the ink delivery port is located is a bottom wall of the ink tank chamber having the ink delivery port.

9. The method of claim 4, wherein the ink tank chamber having the ink delivery port and the one or more free ink chambers are located side-by-side.

10. An ink tank structure, comprising:

an ink tank having an ink delivery port and a chamber having the ink tank delivery port and a ceiling;

at least one free ink chamber having a ceiling containing no openings and which is fluidly connected to the ink tank chamber having the ink delivery port to supply ink to the ink tank chamber having the ink delivery port;

an ink wick element located within the ink tank chamber having the ink delivery port and extending to a height within said chamber;

wherein the height of said at least one free ink chamber ceiling is lower than the height of the ink wick element in the ink tank chamber having the ink delivery port.

11. The ink tank structure of claim 10, wherein the ink wick element contains ink to a level which is above the height of the at least one free ink chamber ceiling.

12. An ink tank structure comprising:

an ink tank having an ink tank chamber having an ink delivery port and a ceiling;

at least one free ink chamber that has a ceiling containing no openings and that is fluidly connected to the ink tank chamber having an ink delivery port through a partition which contains an opening to supply ink from the at least one free ink chamber to the ink tank chamber having the ink delivery port; and wherein the height of the ceiling of the at least one free ink chamber is lower than the height of the ceiling of the ink tank chamber having the ink delivery port and the partition extends to the ceiling of the ink tank chamber having the ink delivery port.

13. A method of reducing an amount of trapped air in an ink tank free ink chamber, the ink tank containing:

at least one free ink chamber having a ceiling containing no openings and that is an uppermost portion of the at least one free ink chamber; and an ink tank delivery port chamber having a ceiling and containing an ink wick element;

wherein the at least one free ink chamber is located beside, but not below, the ink delivery port chamber, and is separated from the ink delivery port chamber by a partition which extends to the top of the ink delivery port chamber, and permits ink to be supplied from the at least one free ink chamber through the at least one partition to the ink delivery port chamber;

the method comprising forming the ceiling of the at least one free ink chamber at a height below one of a height of the ceiling of the ink delivery port chamber and a fill level of ink in the ink wick element.

14. A method of reducing the amount of air trapped in a free ink chamber of an ink tank containing one or more free ink chambers having a ceiling with no aperture therein and separated from an ink tank chamber having an ink delivery port by a partition with an aperture therein to supply ink to the ink tank chamber having an ink delivery port through the aperture when the ink tank is filled with ink, only one of the one or more free ink chambers being located adjacent to the partition, comprising:

providing the free ink chamber with the ceiling with no aperture therein of each free ink chamber with a lowered ceiling relative to the height of the ceiling of the ink tank chamber having the ink delivery port.

15. The method of claim 14, further comprising filling the ink tank with ink.

16. The method of claim 14, wherein the ink tank chamber having an ink tank delivery port and the at least one free ink tank are located side-by-side.

* * * * *